US006240627B1

(12) United States Patent
Schneider

(10) Patent No.: US 6,240,627 B1
(45) Date of Patent: Jun. 5, 2001

(54) APPARATUS FOR MECHANICAL JOINING

(75) Inventor: Dominik Schneider, Chur (CH)

(73) Assignee: Eckold AG, Trimmis (CH)

( * ) Notice: Subject to any disclaimer, the term of this patent is extended or adjusted under 35 U.S.C. 154(b) by 0 days.

(21) Appl. No.: 09/418,815

(22) Filed: Oct. 15, 1999

(30) Foreign Application Priority Data

Oct. 16, 1998 (DE) ..... 198 47 794

(51) Int. Cl.[7] ..... B23P 21/00; B23Q 15/00
(52) U.S. Cl. ..... 29/715; 29/283.5; 29/521
(58) Field of Search ..... 29/521, 522.1, 29/715, 283.5, 252

(56) References Cited

U.S. PATENT DOCUMENTS

| | | | | |
|---|---|---|---|---|
| Re. 31,535 | * | 3/1984 | Schleicher | 29/798 |
| 3,948,427 | * | 4/1976 | Chaydon et al. | 29/522 |
| 4,569,111 | * | 2/1986 | Mutou | 29/283.5 |
| 5,267,383 | * | 12/1993 | Sawdon | 29/283.5 |
| 5,528,815 | * | 6/1996 | Webb | 29/243.5 |
| 5,829,299 | * | 11/1998 | Wessels | 29/894.35 |

FOREIGN PATENT DOCUMENTS

| | | |
|---|---|---|
| 0 077 932 | 12/1984 | (EP) . |
| 0 366 987 | 10/1989 | (EP) . |

* cited by examiner

*Primary Examiner*—S. Thomas Hughes
*Assistant Examiner*—Jermie E. Cozart
(74) *Attorney, Agent, or Firm*—Townsend and Townsend and Crew LLP

(57) ABSTRACT

The invention relates to an apparatus for mechanically joining metal sheets, which lie flat one upon the other, by metal forming, having a tool set comprising at least one punch and one die which bounds a cavity in which the joining operation takes place, it being the case that at least one of these two tool parts can be driven via a driving force, produced by fluid supply, such that the punch displaces sheet-metal material out of a sheet-metal plane, and upsets it, under the action of deformation work, and the driveable tool part has a stop which is moved along with it and limits its penetration depth. For easy displacement limitation, it is provided that the stop is formed by a switching bolt which, upon reaching a selectable penetration depth, can be displaced against a switching linkage which can be brought into releasable latching engagement with a closing element of a valve which is arranged in the fluid supply and is intended for depth limitation, wherein the latching engagement is provided for maintaining a throughflow position of the valve, and the switching bolt is designed as a follower element, acting on the switching linkage, for disengaging the switching linkage from the closing element and switching the valve into a blocking position for the purpose of interrupting the fluid supply.

16 Claims, 8 Drawing Sheets

APPARATUS FOR MECHANICAL JOINING

CROSS-REFERENCE TO RELATED APPLICATION

This application claims the benefit of priority from German Application No. 198 47 794.5, filed Oct. 16, 1998, the full disclosure of which is incorporated herein by reference.

BACKGROUND OF THE INVENTION

1. Field of the Invention

The invention relates to an apparatus for mechanically joining metal sheets, which lie flat one upon the other.

In the case of mechanical joining by means of deformation, small three-dimensional formations are formed on sheet-metal parts, which are to be connected at connecting locations, under the action of tool sets, which each comprise a punch and die, said three-dimensional formations being the joining elements. These joining elements are formed in that, in a joining region, the sheet-metal material of the sheet-metal parts, which lie flat one upon the other, is jointly displaced out of a sheet-metal plane and upset. This is also referred to as clinching.

2. Description of the Background Art

A joining tool which can be used for this purpose is known, for is example, from EP 0 077932 B1. In this document, a joining region is bounded by a press-driven punch and a stationary die. If the punch is moved in the direction of the die the material of the metal sheets is deep-drawn in a cavity of the die. If the die-side metal sheet reaches the base of the cavity, which is formed by an anvil, and if the pressure on the punch is maintained or increased, the base of the press-joined joining section may spread out laterally since the material is upset and the walls which bound the die cavity laterally yield. It is also known, from EP 0 366 987 A1, that, in the case of such a joining tool, the punch has a stop which limits its penetration depth. The penetration-depth limitation, and thus a displacement-limiting means, of the punch ensures that the joining is not subjected to excessive stressing. However, it has proven disadvantageous that the known displacement-limiting means is fixed and subjects the joining tool to mechanical loading.

SUMMARY OF THE INVENTION

The object of the invention is thus to provide an apparatus for mechanical joining which is equipped with a displacement-limiting means which operates easily and quickly.

This provides an apparatus for mechanical joining which is equipped with a displacement-limiting means, for the driveable tool part, which acts directly on the drive and thus responds particularly quickly. Furthermore, the construction of the joining tool by the switching bolt and the switching linkage is not subjected to loading.

Furthermore, designing the displacement-limiting means with a valve for depth limitation which can be switched from a throughflow position into a blocking position, initiated by a switching bolt which is carried along by the driveable tool part and, upon reaching a selectable penetration depth, moves a catch, via the switching linkage, out of latching engagement, makes it possible for the penetration depths to be set differently. This improves the adaptation to different sheet-metal materials. Although the initiator for activating the displacement-limiting means is the displacement distance covered by the driveable tool part, displacement-distance measurement does not have to be carried out. The depth limitation is initiated by the penetration depths actually present in the case of each joining operation. This thus ensures that the predetermined penetration depth is not exceeded.

The switching linkage can easily be guided on the tool set without obstructing the construction of the latter. In this case, the switching linkage may be guided such that a catch provided on the switching linkage is supported on the tool set with spring prestressing. This can achieve the situation where the switching linkage being carried along by the switching bolt, this carry-along operation leading to the catch being moved away from the closing element of the valve for depth limitation in order to achieve disengagement, results in the spring prestressing being enhanced. Independent return of the catch into latching engagement following completion of the joining operation is made easier by this increased spring prestressing.

The catch is preferably designed as a pin-like latching element which can engage in a latching means via a rectilinear stroke movement in that it protrudes in a movement direction of the closing element. Even just a small stroke then causes latching engagement and disengagement.

The fluid supply is preferably equipped with a valve-control circuit which, in addition to the valve for depth limitation, has at least one start valve as a pilot valve, which can be actuated by means of a control lever in order to initiate a joining operation.

Furthermore, the fluid supply can be used for subjecting the driveable tool part to the action of a pressure-exerting force for prestressing the driveable tool part against the metal sheets at the beginning of the joining operation as well as for subjecting the driveable tool part to the action of a stripping force for stripping the metal sheets from the driveable tool part at the end of the joining operation. The respective drive means of the usually pneumatically or hydraulically operated tool set is thus used for driving a plurality of functional elements of the tool set, it being possible for a control sequence to be controlled by valves.

Further configurations of the invention can be gathered from the dependent claims and from the following description.

The invention is explained in more detail hereinbelow with reference to the exemplary embodiment illustrated in the attached drawings, in which:

DETAILED DESCRIPTION OF THE INVENTION

Figure 1:
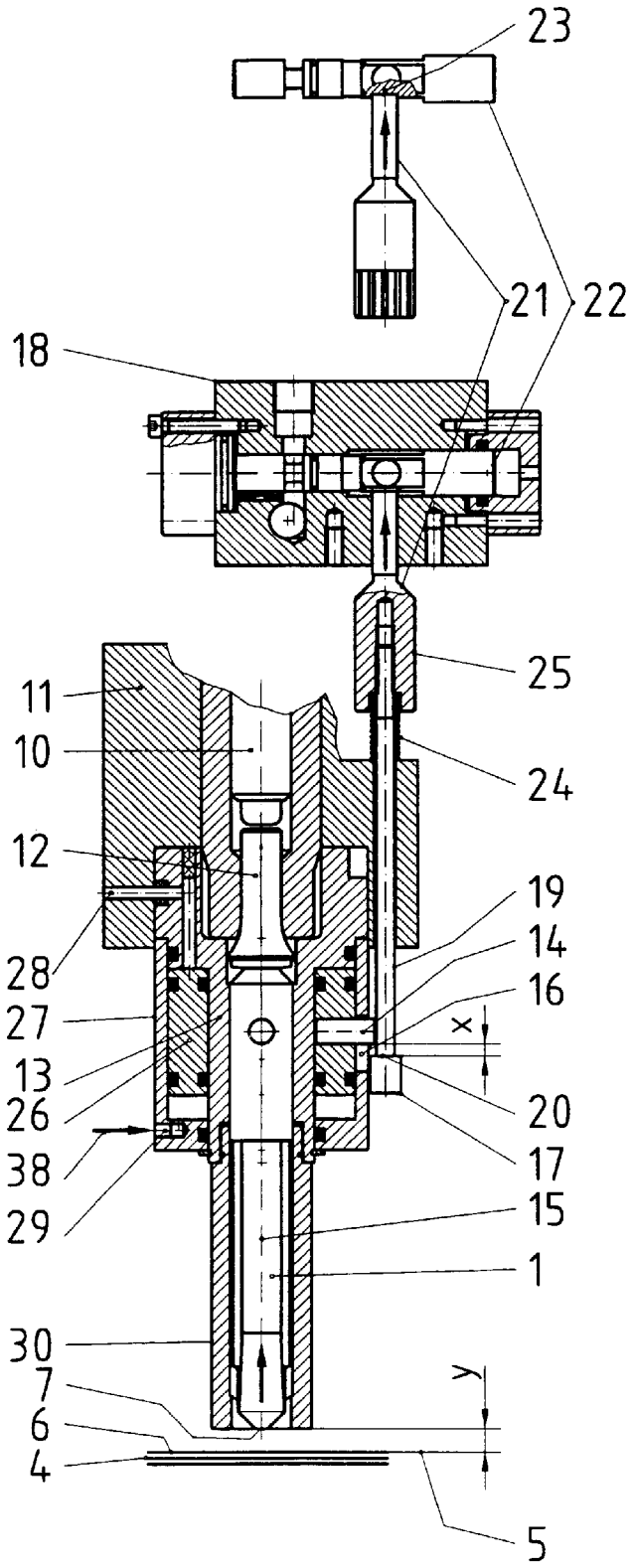
FIG. 1 shows, in partly broken-away form, a longitudinal section of a tool set which has a displacement-limiting means and is illustrated in a standby position.
Figure 2:
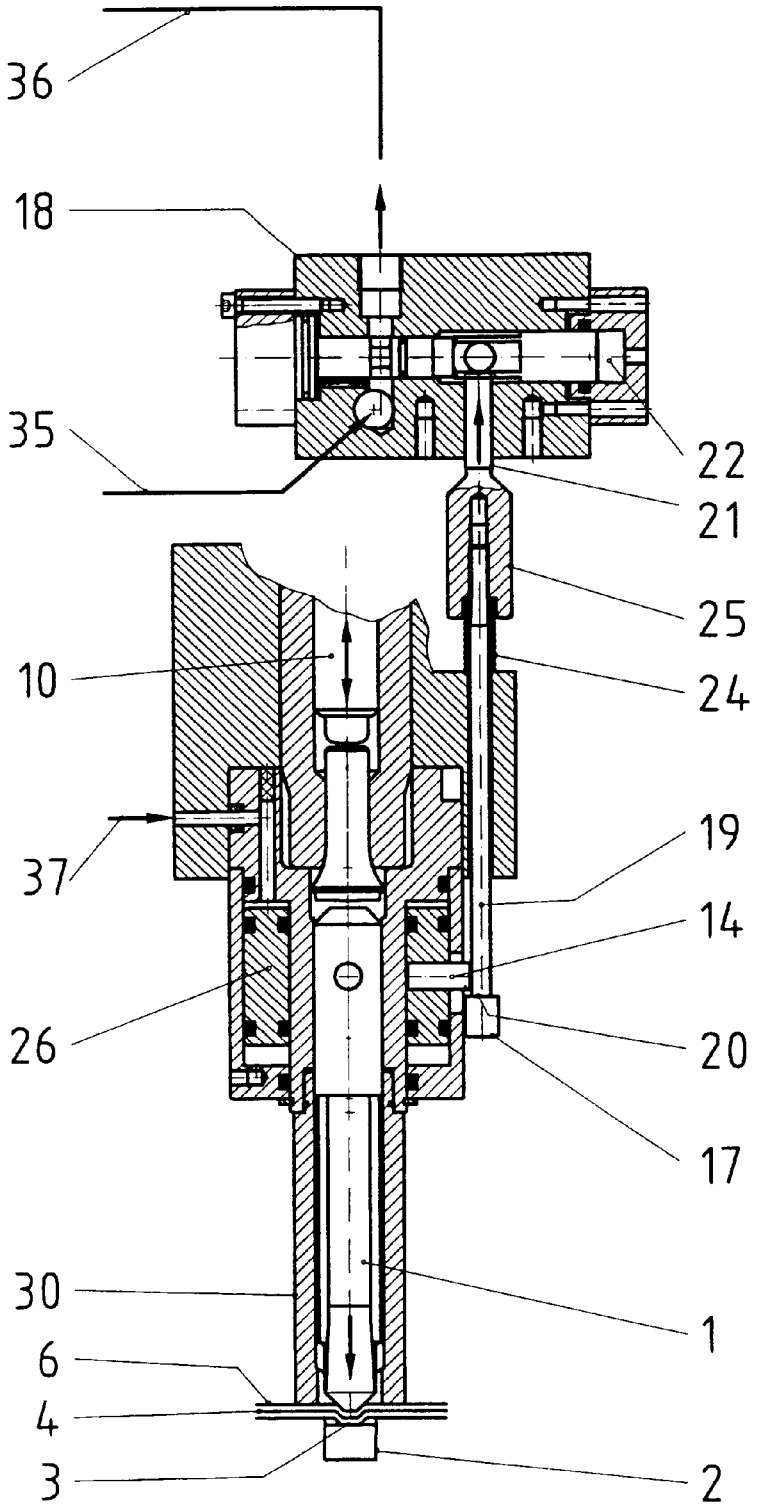
FIG. 2 shows, in partly broken-away form, a longitudinal section of the tool set according to FIG. 1 during joining.

FIGS. 1 and 2 show an apparatus for mechanically joining metal sheets 4, which lie flat one upon the other, by metal forming, having a tool set comprising at least one punch 1 and die 2 which bounds a cavity 3 in which the joining operation takes place. The punch 1 and the die 2 form tool parts of which at least one can be driven, in order that the punch 1 displaces sheet-metal material out of a sheet-metal plane, and upsets it, jointly under the action of deformation work. It is possible to select the number of metal sheets 4 which are located one upon the other and are to be joined, this number being at least 2.

A characterizing variable of the die 2 in this case is a press-joining depth DT, which is determined by the cavity 3. The cavity 3 results from a hollow form of the die 2 with a base-side anvil and shaped elements which project upwards therefrom, can be pivoted out laterally and are intended for bounding the cavity 3. The press-joining depth DT is thus a fixed design feature for joining.

The joining operation itself involves a penetration depth ET for the punch 1, which is pressed into a locally bounded sheet-metal region and, for this purpose, penetrates into the cavity 3 of the die 2 in order to press-join the sheet-metal material in the cavity 3 and to upset it on the anvil. The penetration depth ET is then the distance between the surface plane 5 of the punch-side metal sheet 6 and an imprint of a punch end surface 7 on the base 8 of a joining element 9 (see FIG. 4).

According to the exemplary embodiment, a drive means acts on the punch 1 in order to displace the latter against the die 2. For this purpose, use is made of pneumatic or hydraulic advancement device, e.g. presses or else percussive drive means. Provided in this case is a percussive drive means 34 (hammer) with a hammer piston 10 which is guided as a free-floating piston in a cylinder-like rectilinear guide 11. The two sides of the hammer piston 10 are subjected alternately and in quick succession to the action of the fluid supply, in particular compressed air. The feed and discharge lines for the fluid supply are not illustrated. The hammer piston 10 then transmits impact stressing in the form of individual blows to an impact bolt 12, which is in engagement with the punch 1.

The punch 1 is guided in a cylinder housing 13 which ensures rectilinear guidance of the punch 1 as it executes its stroke movements. Fastened on the punch 1 is a stop in the form of a switching bolt 14 which extends transversely to a punch axis 15 and protrudes laterally outwards in relation to the cylinder housing 13. Accordingly, the switching bolt 14 follows a stroke movement of the punch 1, for which purpose a cutout 16 is provided in the cylinder housing 13.

The switching bolt 14 is assigned a switching linkage 17 which can assume a defined, fixed position relative to the punch 1 and its switching bolt 14, but said position can be selected, and is explained hereinbelow. The switching linkage 17 is provided in order to transmit an advancement movement of the punch 1 to mechanical actuation of a valve 18, which interrupts the fluid supply and thus brings about joining-depth limitation. The actual penetration depth of the punch 1 is thus used for displacement limitation of the punch 1.

The switching linkage 17 is retained by the rectilinear guide 11 of the tool set and comprises a rod 19 which is guided in a rectilinear guide 11 parallel to the punch axis 15. At its end assigned to the switching bolt 14, the rod 19 has a counteracting stop 20, against which the switching bolt 14 can be displaced with striking action. At an opposite end, the rod 19 has a catch 21, which can be brought into releasable latching engagement with a closing element 22 of the valve 18 for depth limitation. For this purpose, the closing element 22 has a latching means 23 in the form of a recess adapted to the catch 21. The catch 21 is preferably formed here by a pin-like latching element which acts on the closing element 22 in a movement direction thereof. Small engagement depths are then sufficient for the valve 18 to be switched reliably, by means of the catch 21, from a throughflow position into a blocking position. Engagement depths of from 0.15 to 0.3 mm may be mentioned by way of example.

In order that the switching linkage 17 can follow an advancement movement of the punch 1, transmitted by the switching bolt 14, the switching linkage 17 is guided displaceably in the rectilinear guide 11. For this purpose, the switching linkage 17 is supported, by way of the catch 21 on the rectilinear guide 11 via a spring 24. The catch 21 further preferably comprises a setting grip 25, which makes it possible to lengthen or shorten the switching linkage 17, i.e. in this case the rod 19, in order thus to change the setting distance X for a depth limitation.

Accordingly, at the end of the joining operation, the switching linkage 17 transmits an advancement movement of the punch 1 to the catch 21 in that the catch 21 is drawn out of the latching means 23 by being carried along by the switching bolt 14. A control sequence for the fluid supply, using the valve 18 is described hereinbelow in conjunction with FIG. 5.

In the case of the exemplary embodiment illustrated, the punch 1 is provided with an additional pressure-exerting and stripping piston 26 in order for it to be possible also to carry out, by means of the fluid supply, prestressing of the punch 1 against the metal sheets 4 at the beginning of the joining operation and stripping at the end of the joining operation. The pressure-exerting and stripping piston 26 is formed by an annular piston on which the punch 1 is retained and which can be displaced in a cylinder 27, in relation to which it is possible to design the cylinder housing 13 for the punch 1 as a stator. The annular piston 26 can be subjected to the action of a fluid from above via a feed line 28, as a result of which a pressure-exerting force can be exerted on the punch 1. Furthermore, the annular piston 26 may be subjected to the action of a fluid from beneath via a feed line 29 as a result of which a stripping force can be exerted on the punch 1, this drawing back the punch 1 in relation to an adjacent pressure pad 30. Push-in play for the push-in operation of the metal sheets 4 can be pre-selected with a setting distance Y.

As far as the joining operation is concerned, the joining tool is illustrated in a standby position in FIG. 1. The annular piston 26 is subjected to the action of a fluid from beneath and presses the punch 1 into a starting position. The punch end surface 7 is preferably flush with a pressure-exerting surface of the pressure pad 30.

FIG. 2 shows the abovedescribed joining tool at the start of the joining operation and during the same. By virtue of actuation of the start valve 32 (see FIG. 5) in a fluid supply, the annular piston 26 is subjected to the action of fluid from above and presses the punch 1 onto the metal sheets 4. At the same time, the hammer 34 (see FIG. 5) starts and hammers the punch 1 into the metal sheets 4, as a result of which the joining element is produced. During joining, the punch 1 and annular piston 26 move downwards, but the switching bolt 14 is still not in contact with the switching means 17. The switching linkage 17 is latched, by way of the catch 21, into the closing element of the valve 18 and thus retains the latter in the throughflow position. A fluid flows through the valve 18, of which the through-passage is open, via supply line 35, which is routed to the valve 18 from a main valve 31 of the control means for the fluid supply, and, via a supply line 36, to the hammer 34, which moves the hammer piston 10 with striking action.

Figure 3:
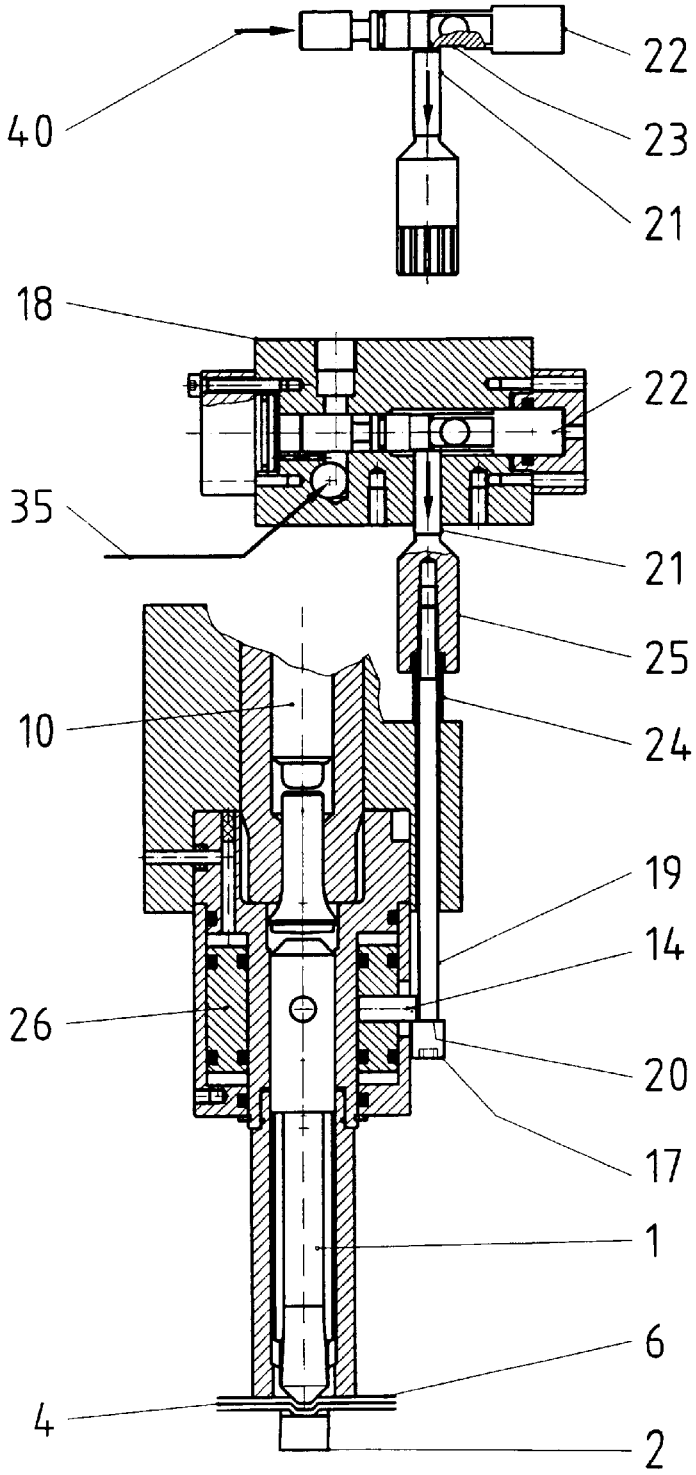
FIG. 3 shows, in partly broken-away form, a longitudinal section of the joining tool according to FIG. 1 at the end of the joining operation.

FIG. 3 shows the abovedescribed joining tool at the end of the joining operation. A setting distance X which has been set for a depth limitation for defining a penetration depth ET has been reached. The switching bolt 14 is put in contact with the switching linkage 17 and, via the latter, draws the catch 21 out of latching engagement with the latching means 23 during further movement. The drawing-out movement is indicated by an arrow in the catch 21. The valve 18 for depth limitation thus responds in that it switches into the blocking position. The pressure medium sent via the supply line 35 is blocked by the valve 18 and the supply line 36 (see FIG. 2) to the hammer 34 is not supplied with any more fluid, i.e. the hammer 34 is disconnected. In order that the valve 18 closes reliably during the disengagement, the valve circuit is pilot-controlled by indirectly acting actuation 40 (see FIG. 5), which in this case takes place pneumatically since compressed air is the fluid used according to the exemplary embodiment. Alternatively, of course, it is also possible to use hydraulic fluids for the fluid supply.

Figure 4:
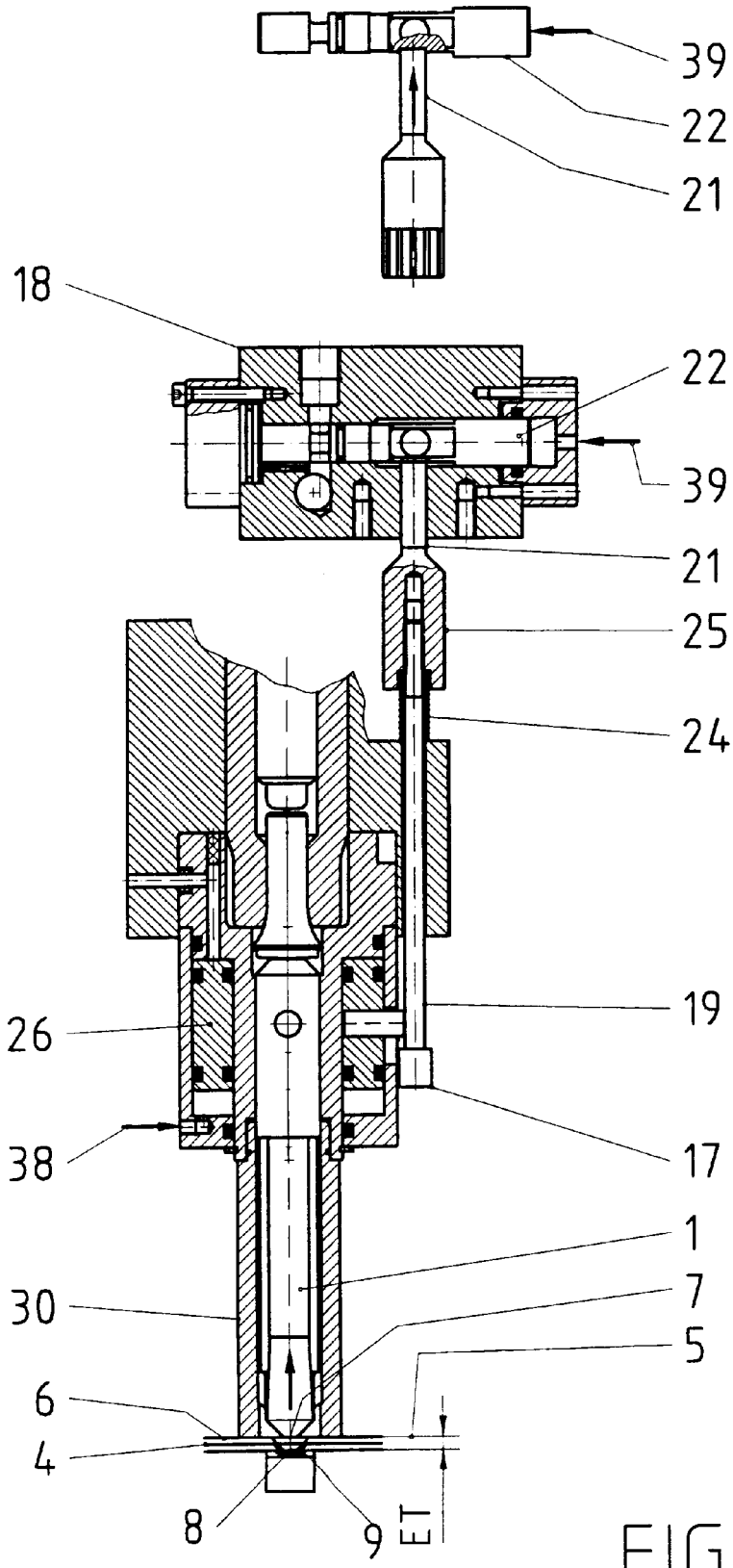
FIG. 4, shows in partly broken-away form, a longitudinal section of the joining tool according to FIG. 1 during stripping and resumption of the standby position.

FIG. 4 shows the abovedescribed joining tool during stripping, in order to resume the standby position. The annular piston 26 is subjected to the action of fluid from beneath and presses the punch 1 into the starting position, the metal sheets 4 being stripped. The valve 18 for depth limitation switches into the operating position, for which purpose the valve 18 is switched by an actuating means. Provided for this purpose is a reset valve 33 which emits an actuating impulse to the valve 18 via a supply line 39. The closing element 22 moves into the throughflow position, in which the catch 21, which butts against the closing element 22 under spring prestressing by way of the spring 24, latches into the latching means 23. This completes a joining cycle.

The displacement-limiting means of the abovedescribed apparatus functions irrespective of the design of the punch 1 with an annular piston 26 for forming prestressing and stripping forces. Such an annular piston 26 is not necessary for fastening the switching bolt 14 on the punch 1. Since the valve 18 is connected to a control sequence for the fluid supply of the hammer 34, it is advantageous for said control means also to include the prestressing and stripping forces and thus for the punch 1 to be provided with an annular piston 26.

Figure 5:
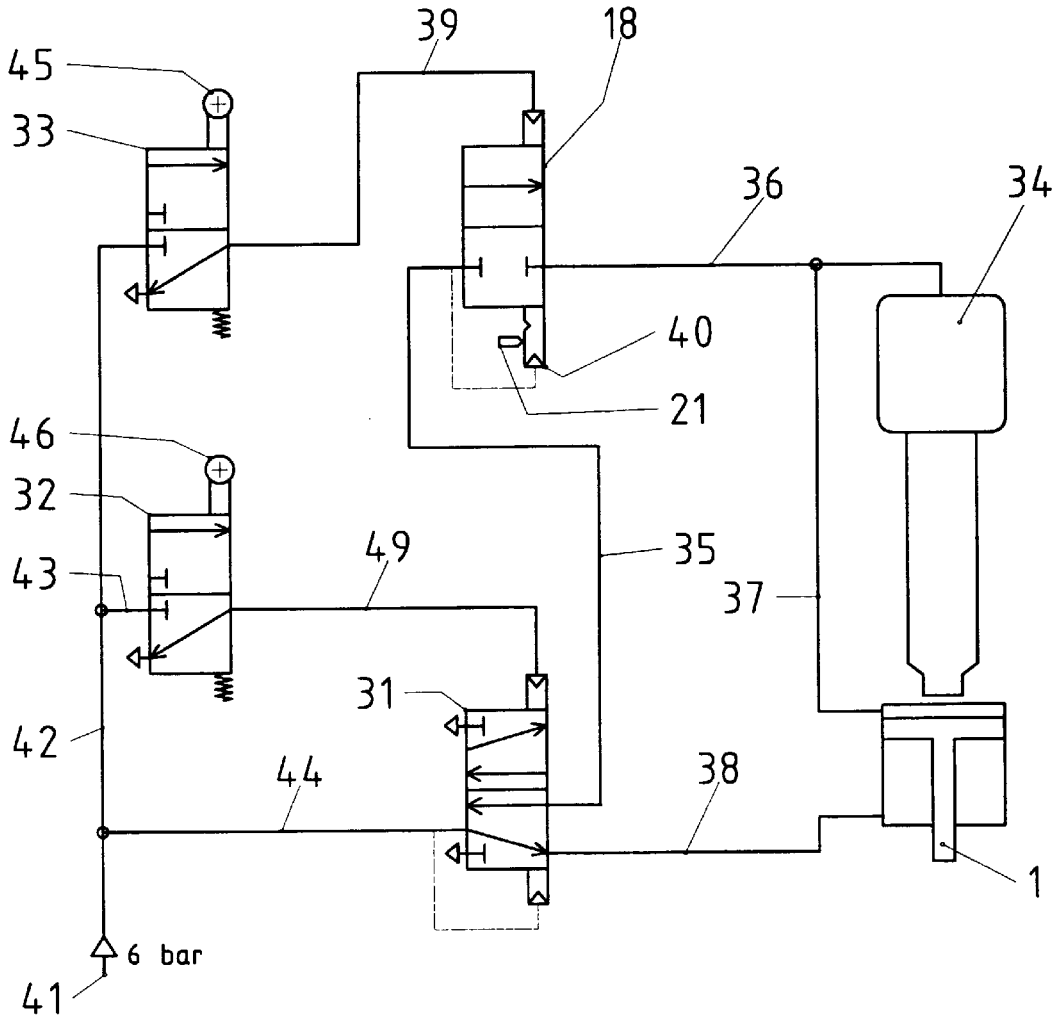
FIG. 5 shows a circuit diagram for controlling a fluid supply by valves.

The circuit diagram for a control sequence for the fluid supply is illustrated in FIG. 5, which has already been referred to a number of times above. According to said diagram, a fluid-supply source 41 is first of all provided. The fluid used may be, in particular, compressed air or hydraulic fluid. This pressure medium is applied with a selectable pressure, which in this case is, for example, 6 bar. Via supply lines 42, 43, 44, said pressure medium is applied in parallel to a start valve 32, a reset valve 33 and a main valve 31. The start valve 32 and the reset valve 33 are each 3/2-way valves, each being actuated by contact-rollers with a restoring spring. Acting on the contact rollers 45 and 46 is a control lever 47 (see FIGS. 6 to 8) of a pivotable activating arm 48 for executing a joining operation.

Figure 6:
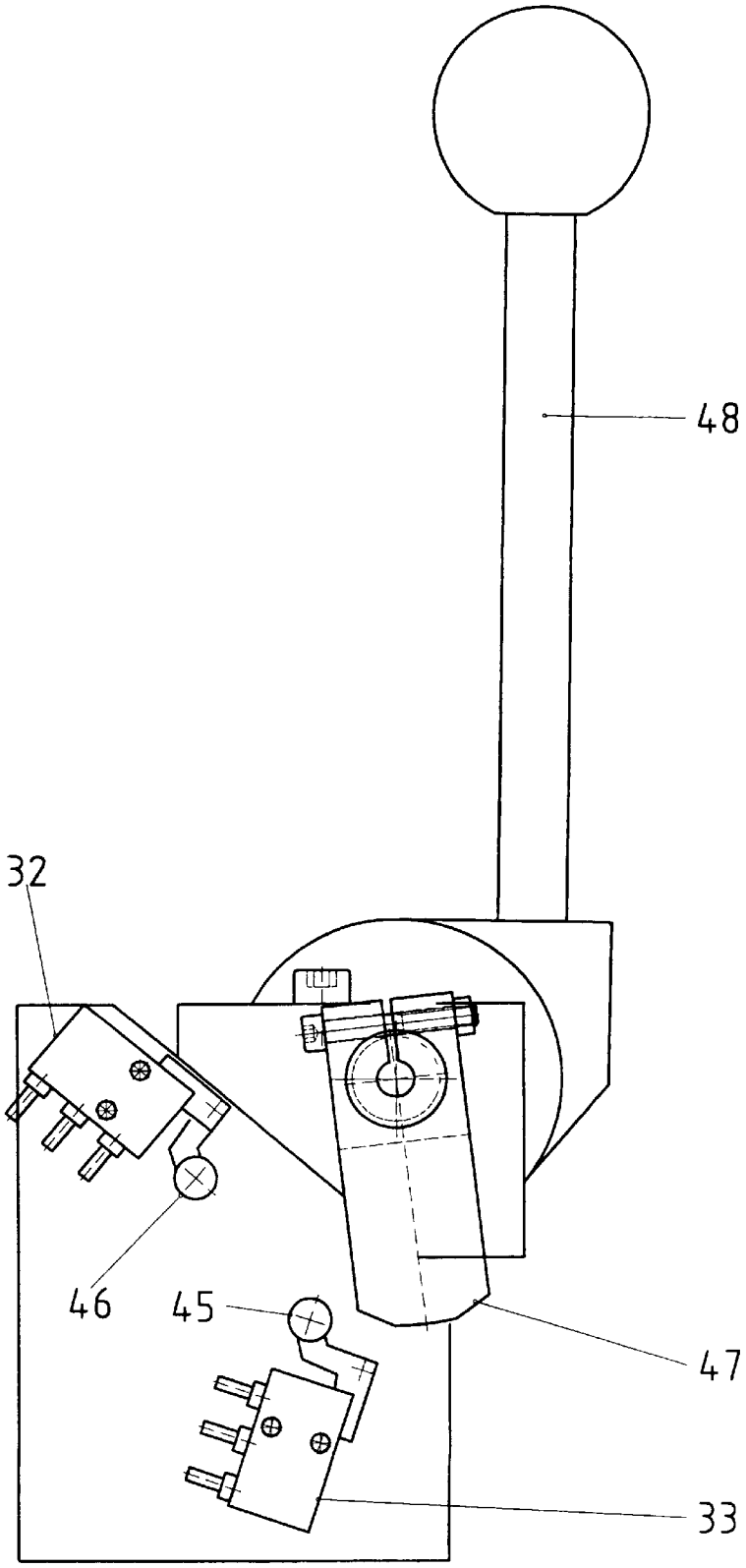
FIG. 6 shows a plan view of an arrangement of a control lever in relation to a start valve and a reset valve for the tool set in the standby position according to FIG. 1.

The main valve 31 is pilot-controlled by start valve 32, i.e. if the start valve 32 is switched into the throughflow position by actuation of the contact roller 46, then the lines 42 and 49 are connected and the main valve 31 is pressure-actuated via the line 49. The main valve 31 is a 5/2-way valve which, as long as it is not subjected to the action of pressure by the start valve 32, connects supply lines 44 and 38 and thus applies pressure medium from the pressure-medium source 41 to the joining tool in order for the annular piston 26 to be subjected to the action of fluid from beneath, as described in relation to FIG. 1. The joining tool is located in the standby position. An associated position of the activating lever 48 for manual initiation of a joining operation is illustrated in FIG. 6.

Figure 7:
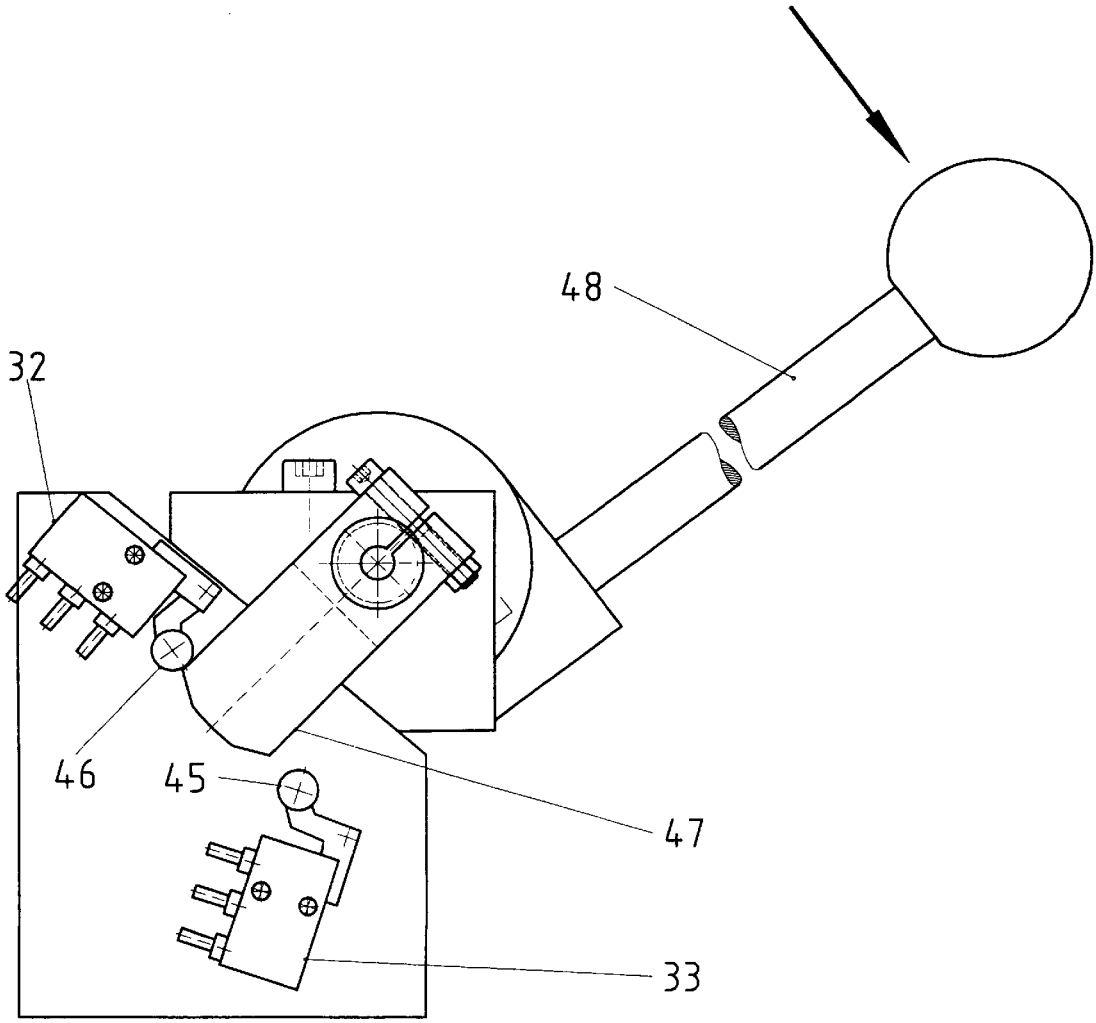
FIG. 7 shows the arrangement according to FIG. 6 for the tool set during joining according to FIGS. 2 and 3.
Figure 8:
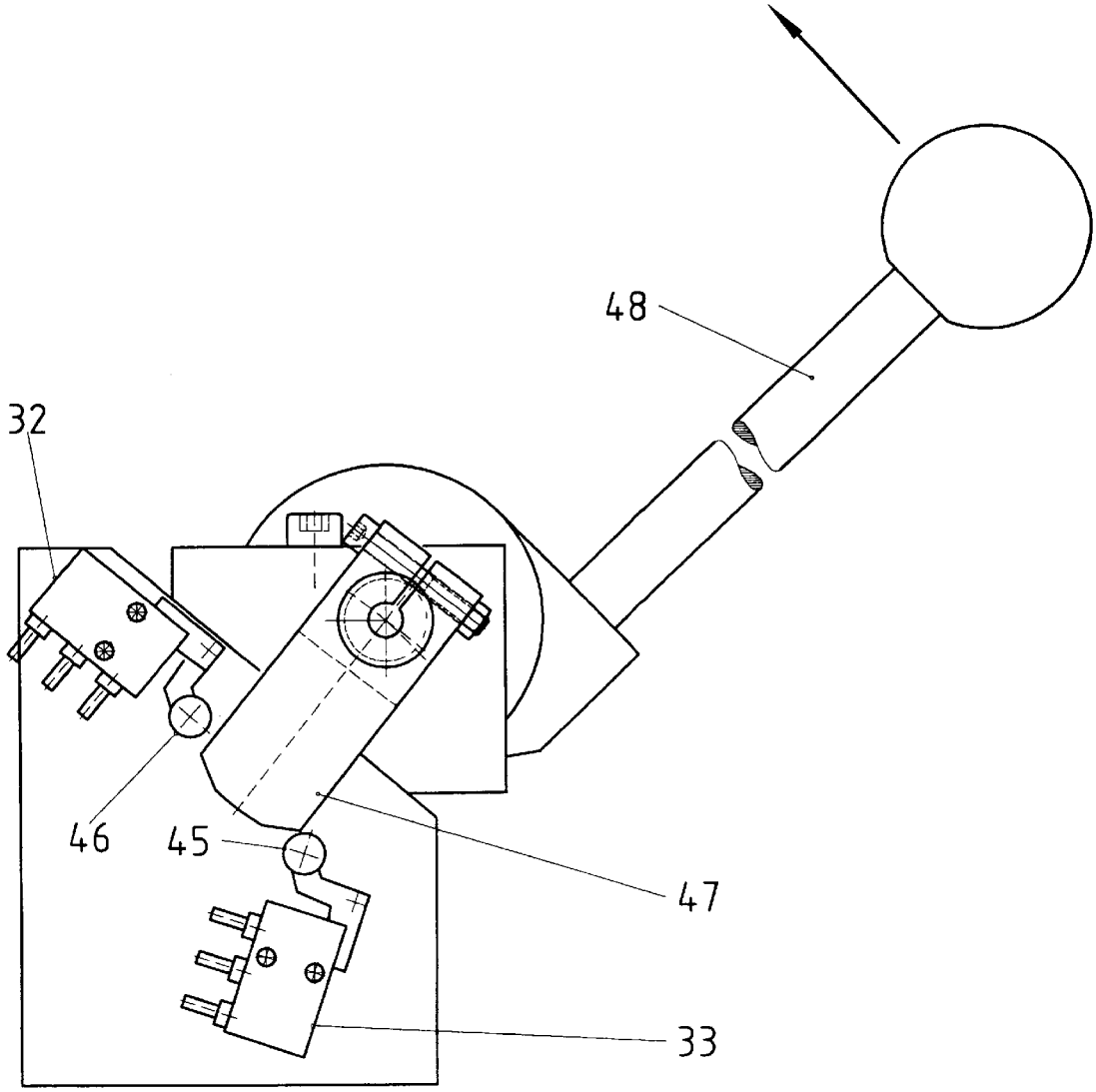
FIG. 8 shows the arrangement according to FIG. 6 for the tool set during stripping and resumption of the standby position according to FIG. 4.

If, however, the start valve 32 is switched into the throughflow position by actuation of the contact roller 46, which is achieved according to FIG. 7 by manual pivoting of the activating arm 48, the main valve connects the lines 44 and 35. If the valve 18 is likewise switched into the throughflow position, i.e. the catch 21 is in releasable latching engagement with the latching means 23, then the lines 35 and 36 are also connected. The line 36, which supplies the hammer 34 with pressure medium, causes the hammer 34 to hammer. A line 37, which branches off from the line 36, simultaneously subjects the annular piston 26 to the action of pressure medium from above for the prestressing, in order that the punch 1 preferably does not move on the metal sheets 4 in an uncontrolled manner at the beginning of the impact joining. It is also possible to provide a further valve in order for the prestressing to be applied at a time prior to the impact joining.

The hammer 34 hammers the punch 1 into the metal sheets 4 until the switching bolt 14 strikes against the switching linkage 17 and carries the latter along in the downward direction at least to a slight extent as the hammer 34 continues hammering. The valve 18 responds in the abovedescribed manner by way of disengagement, as a result of which the connection between the lines 35 and 36 is interrupted and the hammer 34 can no longer effect a striking action. In order to bring the joining tool into the standby position again following completion of the joining operation, according to FIG. 8 the activating lever 48 is pivoted out of contact with the contact roller 46 of the start valve 32. This eliminates the pilot control for the main valve 31, i.e. the connection of the lines 44 and 35 is interrupted and the lines 44 and 38 are thus connected. The annular piston 26 of the punch 1 is then again subjected to the action of pressure medium from beneath, this, following joining, resulting in stripping of the metal sheets 4 since the punch 1 is drawn back in relation to the pressure pad 30 (see FIG. 4).

In order to switch the valve 18 for depth limitation into the throughflow position again, the activating lever 48 is pivoted in order for the contact roller 45 of the reset valve 33 to be actuated by the control lever 47. Since the reset valve 33 is a pilot valve of the valve 18 for depth limitation, switching into the throughflow position takes place by way of the contact-roller actuation. The catch 21 anchors this throughflow position until the punch has gone beyond a depth limitation which corresponds to a selectable penetration depth of the punch 1 and which is defined by the switching linkage 17. A certain setting distance X, which sets the distance between the punch 1 in a first position, in which the punch end surface 7 rests on the punch-side metal sheet 6, and a second position, in which the punch end surface rests on the base of the finished joining element (FIG. 3), can be changed for each joining operation. All that is required for this purpose is for the counteracting stop 20 of the switching linkage 17 to be at a greater or lesser distance from the switching bolt 14 in the first position of the punch 1. Customary values for the setting distance X are from 1 to 5 mm.

In a modification of the abovedescribed exemplary embodiment, the switching linkage 17, in addition to the rod-like design, may also act on the catch 21 via angled elements.

Instead of the activating lever 48, actuation of the valve 32, 33 may additionally take place electrically. The same applies to the initiation of the deformation work for the joining operation. As an alternative to the hammer 34, it is possible to use a conventional press or tongs. Furthermore, it is also possible for the hammer 34 to act on the die, for which purpose the punch 1 and die 2 merely change over their positions in relation to the abovedescribed exemplary embodiment. Moreover, during joining, an auxiliary joining part may be incorporated. Examples of auxiliary joining parts are punch rivets, in particular those with a semitubular rivet, which remain in the joining zone.

Although the invention has been described in some detail by way of illustration and example, for purposes of clarity and understanding, it will be obvious that certain changes and modifications may be practiced within the scope of the invention.

What is claimed is:

1. Apparatus for mechanically joining metal sheets which lie flat one upon the other by metal forming, said apparatus comprising a tool set comprising at least one punch and one die which bound a cavity in which the joining operation takes place, wherein at least one of the punch and die can be hydraulically or pneumatically driven by fluid supply such that the punch displaces and deforms sheet-metal material out of a sheet-metal plane, and the driveable punch or die has a stop comprising a switching bolt which is moved along with it and limits its penetration depth, upon reaching a selectable penetration depth, the driveable punch or die being displaced against a switching linkage which is in releasable latching engagement with a closing element of a valve which is arranged in the fluid supply and is intended for depth limitation of the driveable punch or die, wherein said latching engagement is provided for maintaining a throughflow position of the valve, and the switching bolt comprises a follower element acting on the switching linkage for disengaging the switching linkage from the closing element and switching the valve into a blocking position for the purpose of interrupting the fluid supply.

2. Apparatus according to claim 1, wherein the switching linkage is guided on the tool set for direct transmission of the movement of the switching bolt, which is carried along by the punch, and has a catch for switching the valve.

3. Apparatus according to claim 2, wherein the switching linkage supports a latching element on the tool set with a prestressing spring.

4. Apparatus according to one of claims 1 to 3, wherein the switching linkage is brought into releasable latching engagement via a pin-like latching element, such that the latching element protrudes in a movement direction of the closing element.

5. Apparatus according to one of claims 1 to 3, wherein the closing element of the valve for depth limitation can be returned into releasable latching engagement with the switching linkage via a pilot valve for depth limitation.

6. Apparatus according to one of claims 1 to 3, wherein, for the purpose of setting a selectable penetration depth to which the punch penetrates into the die, the switching bolt has a vertically adjustable counteracting stop against which the switching bolt can be displaced with carry-along action.

7. Apparatus according to one of claims 1 to 3, wherein the switching linkage extends parallel to a stroke direction of the driveable tool part, a counteracting stop being arranged at the end of the switching linkage which engages with the stop, and a catch being arranged at the end of the switching linkage which engages with the valve for depth limitation.

8. Apparatus according to one of claim 1, wherein the valve for depth limitation comprises a start valve.

9. Apparatus according to claim 8, wherein, for the purpose of starting a joining operation, the start valve can be actuated by the actuation of a contact roller.

10. Apparatus according to claim 8, wherein a reset valve is connected in parallel with the start valve for depth limitation and, during a joining operation, said reset valve can be actuated, by the actuation of a contact roller, in each valve before the actuation of the start valve.

11. Apparatus according to claim 10, wherein the contact rollers (46, 45) of the start valve and reset valve can be actuated by a pivotable actuation lever.

12. Apparatus according to one of claims 8 to 11, wherein arranged between the start valve and the valve for depth limitation is an additional main valve which, when the start valve has not been actuated, can supply fluids to the driveable tool in order to subject the latter to the action of stripper forces.

13. Apparatus according to one of claims 1 to 3, wherein the driveable tool is formed by the punch, which extends from a piston guided in a cylinder, and the cylinder, which can be subjected to the action of a fluid supply, limits upward and downward movements of the punch.

14. Apparatus according to claim 13, wherein, for a raising action of the punch, the cylinder can be subjected to the action of a fluid supply from beneath, thereby drawing back the punch in relation to a pressure pad forming a stripping piston.

15. Apparatus according to claim 14, wherein, for lowering the punch onto the metal sheets, the cylinder can be subjected to the pressure-exerting piston.

16. Apparatus according to claim 14 or 15, wherein valve-controlled switchover from the piston being subjected to the action of fluid to a prestressing position of the punch can be effected by valve-controlled fluid supply.

* * * * *

UNITED STATES PATENT AND TRADEMARK OFFICE

CERTIFICATE OF CORRECTION

PATENT NO. : 6,240,627 B1
DATED : June 5, 2001
INVENTOR(S) : Schneider, Dominik

It is certified that error appears in the above-identified patent and that said Letters Patent is hereby corrected as shown below:

Column 8,
Lines 27-28, please change the following:
10. Apparatus according to Claim 8, wherein a reset valve is connected in parallel with the start valve for depth limitation and, during a joining operation, said reset valve can be actuated, by the actuation of a contact roller, respectively, before the actuation of the start valve.

Signed and Sealed this

Tenth Day of December, 2002

JAMES E. ROGAN
*Director of the United States Patent and Trademark Office*